US007437782B1

(12) United States Patent
Burns

(10) Patent No.: US 7,437,782 B1
(45) Date of Patent: Oct. 21, 2008

(54) LOAD SENSING SAFETY DEVICE FOR VERTICAL LIFT

(75) Inventor: Ralph E. Burns, Louisville, CO (US)

(73) Assignee: Joerns Healthcare Inc., Stevens Point, WI (US)

( * ) Notice: Subject to any disclaimer, the term of this patent is extended or adjusted under 35 U.S.C. 154(b) by 386 days.

(21) Appl. No.: 11/327,667

(22) Filed: Jan. 6, 2006

(51) Int. Cl.
*A61G 7/10* (2006.01)
*B66D 1/06* (2006.01)
*B66F 17/00* (2006.01)

(52) U.S. Cl. ..... 5/87.1; 5/83.1; 5/81.1 R; 254/385; 254/391

(58) Field of Classification Search ..... 5/87.1, 5/81.1 R, 83.1, 86.1, 89.1, 81.1 T; 254/2 R, 254/4 R, 4 B, 2 B, 265, 266, 268, 269, 278, 254/364, 385, 391, 393, 394, 392, 413, 414; 414/496, 539–543, 560, 561, 592, 921; 212/276, 212/278, 281, 199, 330, 331, 345, 347, 901; 29/892, 892.1, 892.11, 892.2, 892.3; 474/166, 474/197, 199; D8/360
See application file for complete search history.

(56) References Cited

U.S. PATENT DOCUMENTS 2,793,768 A * 5/1957 Schaedler ..... 414/541
2,962,730 A * 12/1960 Carnes et al. ..... 5/86.1
3,641,906 A * 2/1972 Orr et al. ..... 134/57 D
3,666,131 A * 5/1972 Thompson ..... 414/608
3,744,188 A * 7/1973 Sharpless ..... 451/350
3,754,631 A * 8/1973 Wang et al. ..... 400/76
3,872,959 A * 3/1975 Wang et al. ..... 400/65
3,931,915 A * 1/1976 Downings et al. ..... 222/327
3,962,737 A * 6/1976 James ..... 5/83.1
3,981,484 A * 9/1976 James ..... 264/148
4,367,033 A * 1/1983 Watanabe ..... 399/144
4,598,432 A * 7/1986 Pennington-Richards ... 4/563.1
4,624,019 A * 11/1986 Pennington-Richards ... 4/566.1
4,633,538 A * 1/1987 James ..... 5/83.1
4,644,595 A * 2/1987 Daniel ..... 5/83.1
4,660,574 A * 4/1987 Kobayashi et al. ..... 131/105
4,681,505 A * 7/1987 Kobayashi et al. ..... 414/744.6
4,856,123 A * 8/1989 Henderson et al. ..... 4/480
5,020,169 A * 6/1991 Hamada et al. ..... 5/10.2
5,111,673 A * 5/1992 Kadoya et al. ..... 68/12.04
5,333,334 A * 8/1994 Kassai ..... 5/85.1
5,348,273 A * 9/1994 Sandell et al. ..... 254/385
5,737,782 A * 4/1998 Matsuura et al. ..... 5/86.1
5,839,134 A * 11/1998 Matsuura et al. ..... 5/504.1

(Continued)

FOREIGN PATENT DOCUMENTS

EP 155217 A1 * 9/1985

(Continued)

*Primary Examiner*—Robert G Santos
(74) *Attorney, Agent, or Firm*—MacMillan, Sobanski & Todd, LLC

(57) ABSTRACT

A load sensing safety device comprises a pulley shaft carrying a pulley. The pulley, in turn, carries a belt that effectuates movement of the patient lift boom. A biasing element applies a spring force against the pulley shaft to move the pulley shaft in a first direction. A switch that opens and closes responsive to movement of the pulley shaft, whereby the switch opens where the pulley shaft is moved to a first position by movement of the spring in the first direction.

12 Claims, 5 Drawing Sheets

U.S. PATENT DOCUMENTS

| | | | | |
|---|---|---|---|---|
| 5,918,449 | A * | 7/1999 | Rush et al. | 56/10.8 |
| 5,943,715 | A * | 8/1999 | Matsuura et al. | 5/81.1 R |
| 6,035,465 | A * | 3/2000 | Rogozinski | 5/83.1 |
| 6,116,577 | A * | 9/2000 | McCanse | 254/2 B |
| 6,256,807 | B1 * | 7/2001 | Steadman | 4/562.1 |
| 2007/0205405 | A1 * | 9/2007 | Stockmaster et al. | 254/275 |

FOREIGN PATENT DOCUMENTS

| | | | |
|---|---|---|---|
| EP | 399836 | A2 * | 11/1990 |
| EP | 424344 | A1 * | 4/1991 |
| WO | WO 8700040 | A1 * | 1/1987 |
| WO | WO 9415568 | A1 * | 7/1994 |

* cited by examiner

LOAD SENSING SAFETY DEVICE FOR VERTICAL LIFT

BACKGROUND OF INVENTION

This invention relates in general to lifts for lifting and transporting patients. More particularly, the invention relates to a load sensing safety device for patient lifts and more particularly for vertical lifts.

Lifts for lifting and transporting patients are well known. Such lifts typically include a base that is usually supported for movement relative to a supporting surface, such as a floor. Extending upwardly from the base is a mast and extending forward from the mast is a boom. From a forward end of the boom is suspended a rigging of some sort, such as a sling hanger for supporting a sling, which in turn is provided for supporting the patient. The boom is displaceable to vertically move the rigging to raise and lower a patient supported by the rigging. With the patient supported by the rigging, the lift may merely support the patient in a fixed position, or the lift may be moved relative to the supporting surface to transport the patient.

There are two common ways in which the boom is typically displaced. In one manner, the boom is supported for pivotal movement relative to the mast and an actuator is angularly disposed between the mast and the boom. Extending the actuator causes a free end of the boom to be raised and contracting the actuator causes a free end of the boom to be lowered. In another manner, the boom is supported for vertical movement relative to the mast. An actuator causes the entire boom to be raised and lowered. The actuator often includes a flexible belt for providing a lifting force for raising and lowering the boom.

The boom and patient support rigging are often very heavy. If the patient should come into contact with an underlying obstruction and the actuator continues to lower the boom, the weight of these components can be applied against the patient, resulting in patient injury. When the lift employs a flexible belt to transmit lifting force, further potential for injury exists if a patient encounters an underlying obstruction because the belt may continue to be extended and accumulate as slack. If the obstruction is suddenly removed, the patient may move abruptly downward until the slack of belt is taken up.

SUMMARY OF INVENTION

The present invention is directed towards a lift for lifting and transporting patients, and a load sensing safety device for the lift. The load sensing safety device comprises a pulley shaft carrying a pulley, which, in turn, carries a belt that effectuates movement of the patient lift boom. A biasing element applies a spring force against the pulley shaft to move the pulley shaft in a first direction. A switch opens and closes responsive to movement of the pulley shaft, whereby the switch opens when the pulley shaft is moved to a first position by movement of the spring in the first direction.

DETAILED DESCRIPTION

Figure 1:
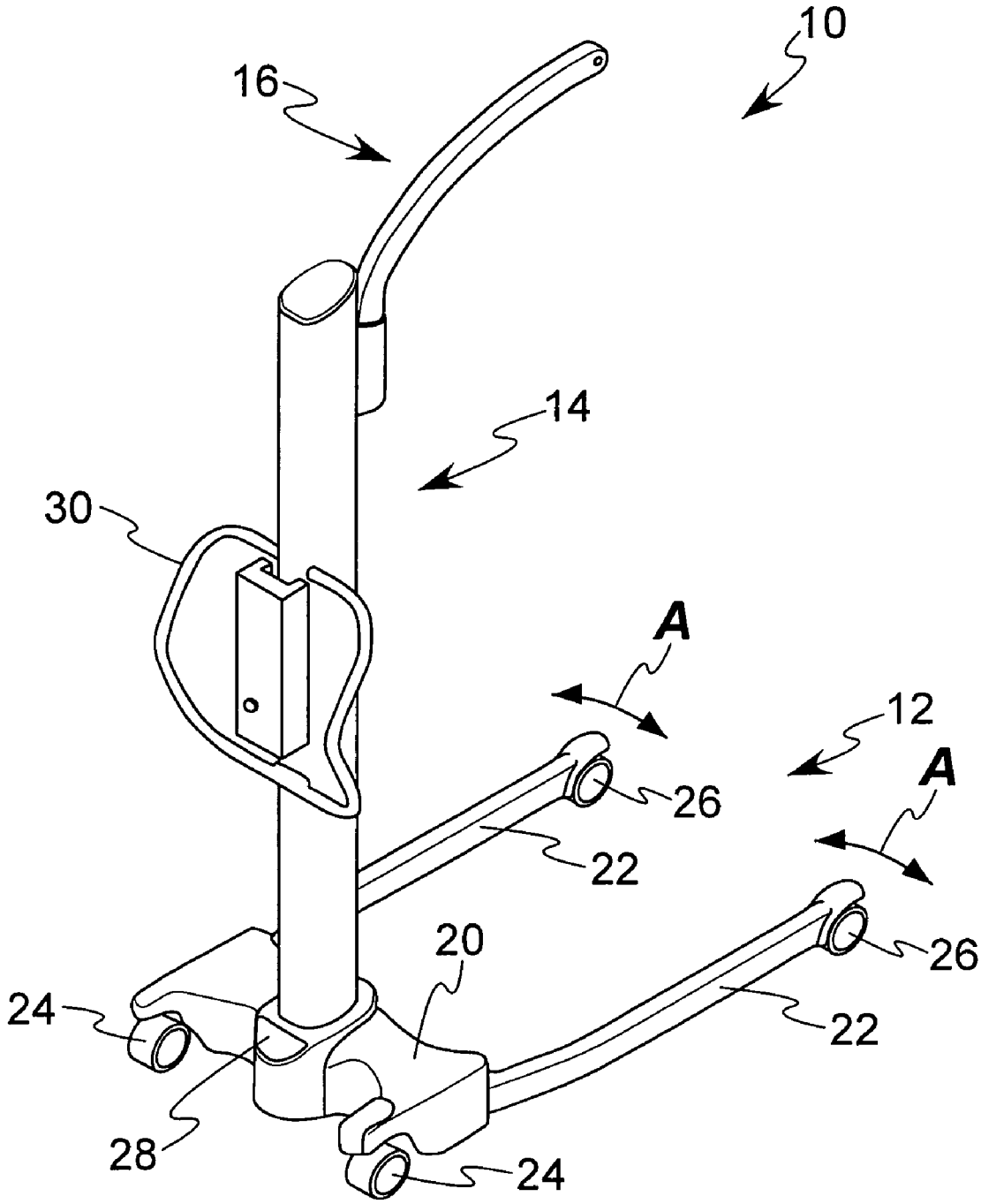
FIG. 1 is a perspective view of a lift for lifting and transporting patients.

Referring now to the drawings, there is illustrated in FIG. 1 a lift 10 for lifting and transporting patients. The lift 10 generally comprises a base 12 supported for movement relative to a supporting surface, a mast 14 extending vertically upward from the base 12, and a boom 16 supported for movement relative to the mast 14. Although not shown, a forward extending free end of the boom 16 is subject to support rigging, such as a cradle or sling hanger, which are well known in the art of the invention.

The base 12 generally includes a housing 20 and legs 22 extending forwardly from the housing 20. The rear end of the base 12 and the forward ends of the legs 22 are supported relative to a supporting surface by rear and front wheels or casters 24, 26. The casters, preferably the rear casters 24, are preferably provided with a brake that may be effectuated by a lever (not shown) to prevent the casters 24 from rotating and thus prevent the lift 10 from moving relative to the supporting surface. To assist an attendant in moving the lift 10, a foot push pad 28 may be provided on the base 12 for application of pressure by the attendant's foot to move the base 12. The mast 14 may also be provided with a handle 30 to aid the attendant in articulating the lift 10 in a desired direction.

Figure 2:
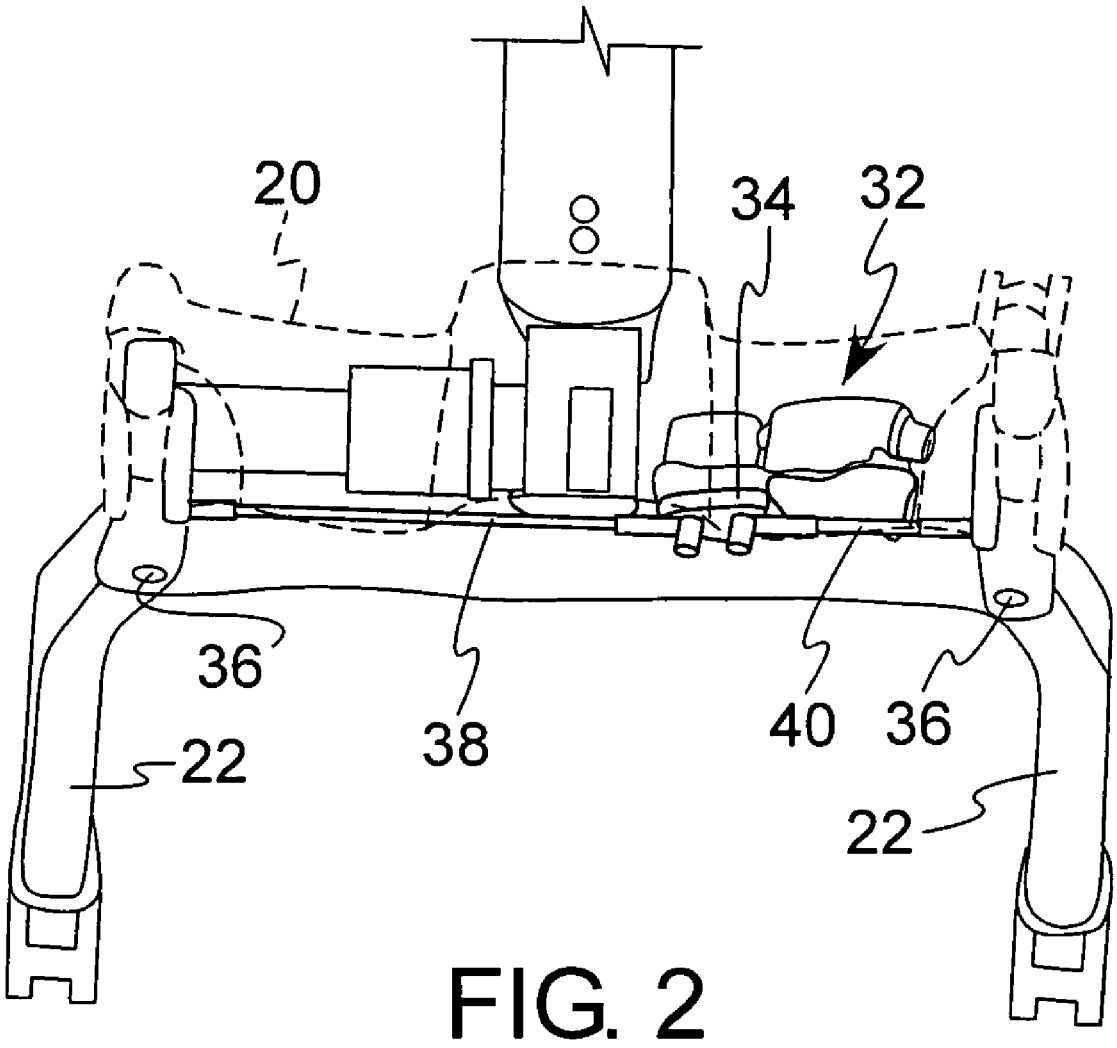
FIG. 2 is an enlarged bottom perspective view of the base with the base housing shown in hidden line to make visible a leg articulation actuator therein for pivotally displacing the legs.

In the exemplary embodiment, the legs 22 are supported for pivotal movement relative to the base seat panel 12 (i.e., along the lines A in FIG. 1). Although this pivotal movement may be accomplished in any suitable manner, in the illustrated embodiment, the movement is accomplished via a leg articulation actuator comprised of, for example, a motor and gearbox arrangement, as generally indicated at 32 in FIG. 2. The motor and gearbox arrangement 32 is supported in fixed relation to the housing 20, as is the pivotal support between the housing 20 and the legs 22. A plate 34 is supported for rotation relative to some fixed point within the housing 20 by the motor and gearbox arrangement 32. The legs 22 are supported for pivotal movement relative to the base 12 by pivotal connections 36. Connected between the plate 34 and the pivotal connections 36 are actuation rods 38, 40, which are displaceable in transverse directions relative to the housing 20 by rotational movement of the plate 34 via operation of the motor and gearbox arrangement 32. Transverse displacement of the actuator rods 38, 40, in turn, moves the legs 22 pivotally relative to the housing 20.

Figure 3:
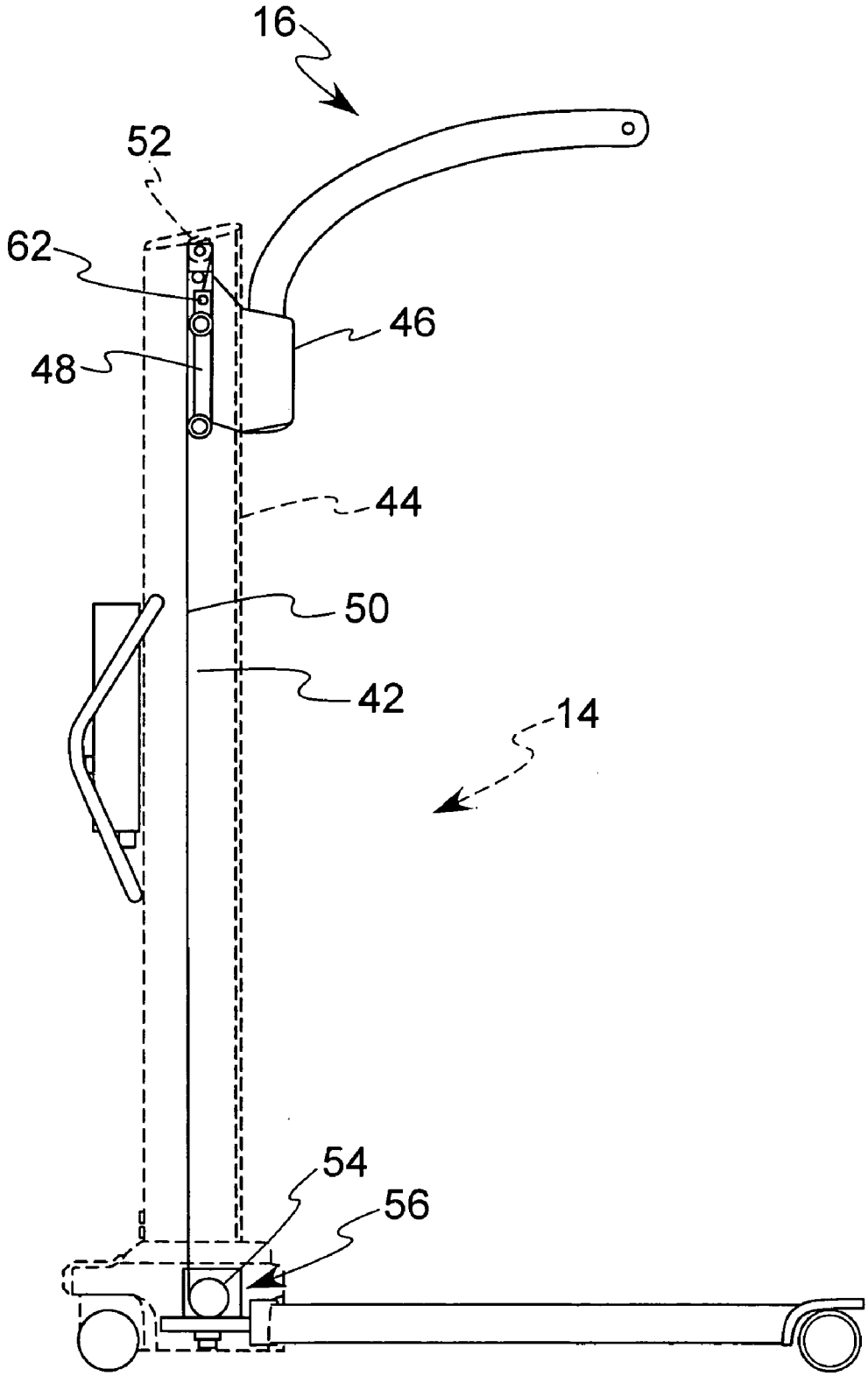
FIG. 3 is a side elevational view of the lift with the mast and the base housing shown in hidden line to make visible a lift actuator therein for raising and lowering the boom.

Now with reference to FIG. 3, there is illustrated a lift actuator for raising and lowering the boom 16. As shown in the drawing, the boom 16 is supported for vertical movement along a track 42 within the mast 14. In the exemplary embodiment, the mast 14 has a forwardly presented, vertically extending opening or slot 44 through which extends a boom support 46. The boom support 46 is carried by a carriage 48. The carriage 48 is supported for vertical movement by a belt 50 that is threaded upwardly over an upper pulley 52 and then downwardly through the mast 14 to a lower pulley 54, which forms a part of a motor and pulley arrangement 56.

Figure 4:
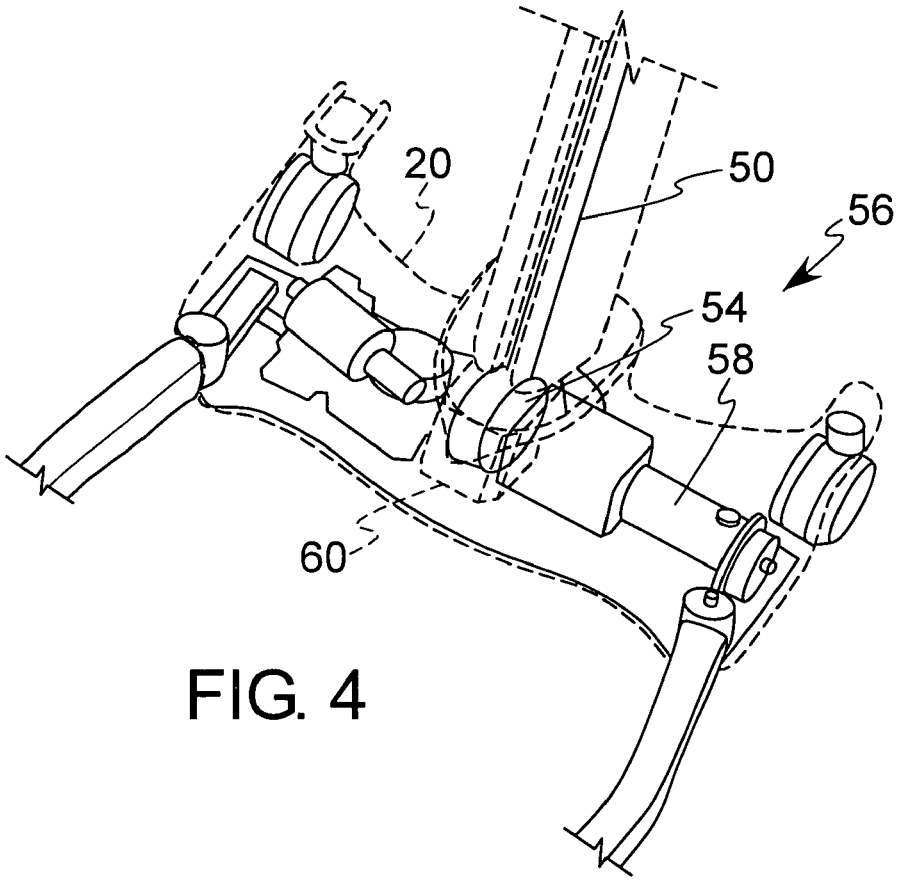
FIG. 4 is an enlarged top perspective view of a motor and pulley arrangement forming a part of the actuator shown in FIG. 3.

An exemplary embodiment of the motor and pulley arrangement 56 is shown in detail in FIG. 4. As shown in the drawings, the motor and pulley arrangement 56 includes a motor 58, which drives the lower pulley 54. The motor 58 is mounted to a pulley housing 60, which houses the lower pulley 54. The pulley housing 60, in turn, is held in a fixed relation to the base housing 20. A lower end of the belt 50 is attached to, and subject to be wound around the lower pulley 54.

Figure 5:
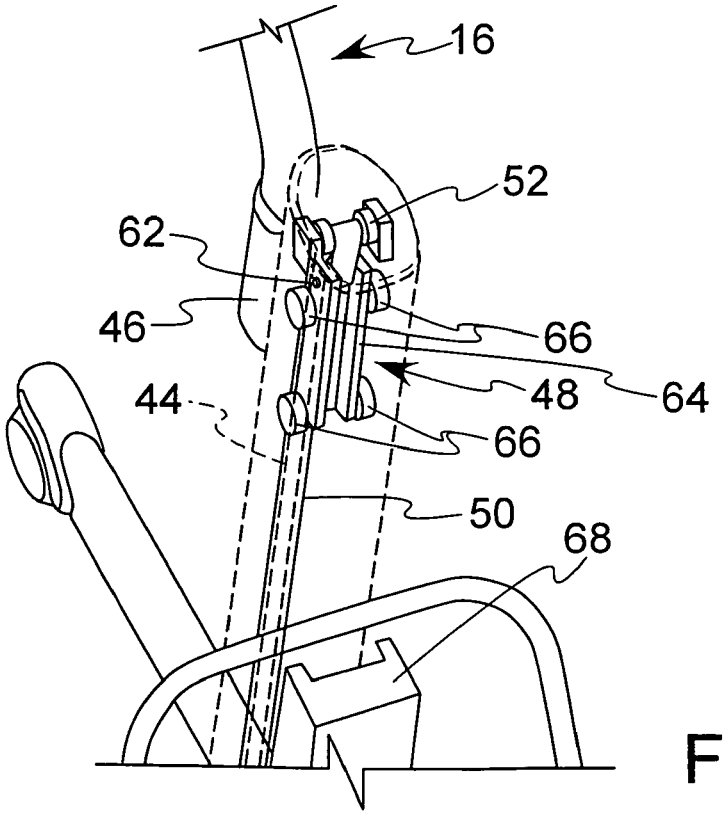
FIG. 5 is an enlarged rear perspective view of a carriage and pulley arrangement forming a part of the actuator shown in FIG. 3.

Now, with reference to FIG. 5, it can be seen that the belt 50 is threaded upwardly and over the upper pulley 52, and then downwardly to the carriage 48, where it is securely attached via, for example, a through pin 62. The carriage 48 comprises a body 64, to which is supported the boom support 46. The carriage body 64 has one or more wheels, and in the particular embodiment shown, has four wheels 66. The wheels 66 are subject to travel along one or more contact surfaces within the mast 14. The mast 14 may be extruded, or otherwise formed, to include formations for receiving the carriage body 64 and tracks for engagement with the accompanying wheels 66.

In operation, as the motor 58 is driven in a first direction, the lower pulley 54 gathers the belt 50, which in turn pulls the belt 50 about the upper pulley 52, wherein the belt 50 pulls the carriage 48 upwardly to raise the boom support 46 and, in turn, the boom 16. Conversely, as the motor 58 is driven in a second direction, opposite to the first direction, the lower pulley 54 releases the belt 50, which travels about the upper pulley 52, allowing the mass of the occupant to pull the boom 16, the boom support 46, and the carriage 48 downwardly.

The leg articulation and lift actuators may be operated in any suitable manner. In the exemplary embodiment, a power supply, such as a DC battery and controller, together with suitable electronics, are supported within the base 12 and mast 14, and further by a battery and controller housing 68, which is attached to the outside the mast 14.

Figure 6:
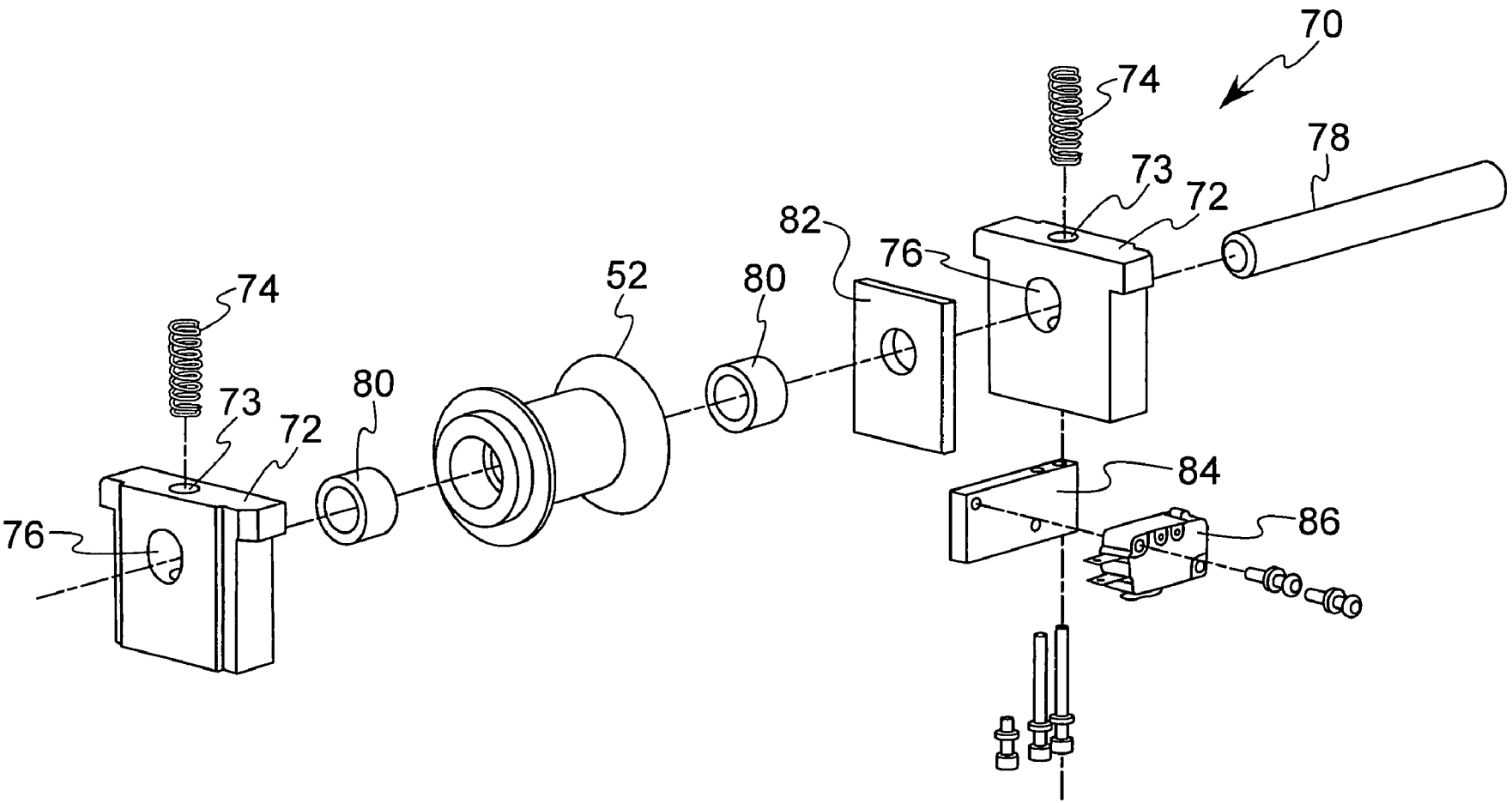
FIG. 6 is an exploded perspective view of the pulley arrangement illustrated in FIG. 5.

Now, with reference to FIG. 6, a description of a load sensing safety device 70 will ensue. There is illustrated an exploded view of a pulley assembly. The assembly comprises a pair of laterally spaced support blocks 72, at least one of which has a bore 73, which extends downwardly, at least partially through the support blocks 72, for receiving a return spring 74, and an elongate hole 76, which extends laterally through the support blocks 72, for receiving a pulley shaft 78. The bores 73 communicate with the holes 76 and the springs 74 are situated in the bores 73 beneath opposing ends of the pulley shaft 78 to apply an upwardly directed spring force against the pulley shaft 78. The holes 76 and the pulley shaft 78 are sized to permit vertical movement of the pulley shaft 78 while substantially prohibiting horizontal movement in a direction perpendicular to the shaft so as to reduce the risk of having horizontal slop between the holes 76 and the shaft 78.

Between the support blocks 72 there is carried by the shaft 78 the upper pulley 52. The upper pulley 52 is supported for ease of movement relative to the shaft 78 by bearings, such as the needle bearings 80 diagrammatically shown.

Between one support block 72 and the upper pulley 52, the shaft 78 further carries a switch plate 82, which moves up and down with the shaft 78 as the shaft 78 moves vertically in the holes 76. Mounted below the switch plate 82 to the same support block 72 is a mounting 84, to which is mounted a switch 86. In the exemplary embodiment, the switch 86 is a normally open switch, which is closed by contact with the switch plate 82 as the switch plate 82 moves downward with the pulley shaft 78.

In operation, a downwardly directed force applied against the upper pulley 52 by the belt 50, when the load of a patient is supported by the boom 16, urges the pulley shaft 78 downwardly against the force of the springs 74. The downward movement of the shaft 78, in turn, causes the switch plate 82 to move downward into contact with the normally open switch 86 to cause the switch 86 to close. This completes the electrical circuit that supplies current to the motor 58 to drive the motor 58 in a desired direction to cause the lower pulley 54 to gather or release the belt 50, which in turn raises or lowers the carriage 48, the boom support 46 and the boom 16 to raise or lower the patient supported by the boom 16.

Now, if the patient should come into contact with an underlying obstruction, continued downward movement of the boom 16 would relieve downwardly directed force applied against the upper pulley 52 by the belt 50, due to a decrease in the load of the patient supported by the boom 16. With insufficient force applied against the upper pulley 52, and thus the pulley shaft 78, the return springs 74 urge the pulley shaft 78 upwardly via the force of the springs 74. The upward movement of the shaft 78, in turn, causes the switch plate 82 to move upward out of contact with the normally open switch 86. This allows the switch 86 to open, which breaks the electrical circuit that supplies current to the motor 58, at least with regard to current that drives the motor 58 to further release to belt 50. This, in turn, prevents the boom 16 from being further lowered, at least until the underlying obstruction is removed.

The principle and mode of operation of this invention have been explained and illustrated in its preferred embodiment. However, it must be understood that this invention may be practiced otherwise than as specifically explained and illustrated without departing from its spirit or scope.

What is claimed is:

1. A load sensing safety device for a patient lift having a boom, the device comprising:

a pulley shaft carrying a pulley, which, in turn, carries a belt that effectuates movement of the patient lift boom;

a support block supporting the pulley shaft for vertical movement;

a biasing element applying a spring force against the pulley shaft to move the pulley shaft in a first direction; and a switch that opens and closes responsive to movement of the pulley shaft, whereby the switch opens when the pulley shaft is moved to a first position by movement of the biasing element in the first direction, wherein the support block has a bore, which extends downwardly, partially through the support block for receiving the biasing element, and an elongate hole, which extends laterally through the support block, for receiving the pulley shaft, the bore communicating with the hole and the biasing element being situated in the bore so as to apply the spring force against the pulley shaft to cause the pulley shaft to move in the first direction.

2. The device of claim 1 further comprising a switch plate carried by the pulley shaft in such a manner that movement of the pulley shaft causes the switch plate to move into contact with the switch to cause the switch to open or close.

3. A load sensing safety device for a patient lift having a boom, the device comprising:

a pulley shaft carrying a pulley, which, in turn, carries a belt that effectuates movement of the patient lift boom;

a pair of support blocks supporting the pulley shaft for vertical movement between the support blocks;

a pair of biasing elements applying a spring force against the pulley shaft to move the pulley shaft in a first direction; and a switch that opens and closes responsive to movement of the pulley shaft, whereby the switch opens when the pulley shaft is moved to a first position by movement of the biasing element in the first direction, wherein the support blocks each have a bore, which extends downwardly, partially through the support blocks, the bores in the support block each receiving a corresponding one of the biasing elements, the support blocks each further having an elongate hole, which extends laterally through the support blocks, for receiving the pulley shaft, the bores communicating with the holes and the biasing elements being situated in the bores so as to apply the spring force against the pulley shaft to cause the pulley shaft to move in the first direction.

4. A pulley assembly for a patient lift having a boom, the assembly comprising:

a pair of laterally spaced support blocks, each having a bore, which extends downwardly, partially through the support blocks, and an elongate hole, which extend laterally through the support blocks, the bores communicating with the holes;

a return spring in each of the bore in each support block;

a pulley shaft extending from the hole in one of the support blocks to the hole in the other one of the support blocks, the holes and the pulley shaft being sized to permit vertical movement of the pulley shaft, the springs being situated in the bores beneath opposing ends of the pulley shaft to apply an upwardly directed spring force against the pulley shaft to move the shaft in the holes.

5. The assembly of claim 4 further comprising a pulley supported by the pulley shaft.

6. The assembly of claim 4 further comprising a switch plate carried by the pulley shaft and which moves vertically with the pulley shaft.

7. The assembly of claim 6 further comprising a mounting mounted to one of the support blocks below the switch plate and a switch mounted to the mounting.

8. The assembly of claim 7 wherein the switch is a normally open switch, which is closed by contact with the switch plate as the switch plate moves vertically in a first direction with the pulley shaft.

9. A patient lift comprising:

a base supported for movement relative to a supporting surface;

a mast extending upwardly from the base;

a boom supported for vertical movement relative to the mast by a carriage having a belt secured thereto, wherein the belt, in turn, is connected to a lower pulley that is driven by a motor to gather the belt to raise the boom and release the belt to lower the boom, the upper end of the belt being threaded through a pulley assembly, the assembly comprising:

a pair of laterally spaced support blocks, each having a bore, which extends downwardly, partially through the support blocks, and an elongate hole, which extend laterally through the support blocks, the bores communicating with the holes;

a return spring in each of the bore in each support block;

a pulley shaft extending from the hole in one of the support blocks to the hole in the other one of the support blocks, the holes and the pulley shaft being sized to permit vertical movement of the pulley shaft, the springs being situated in the bores beneath opposing ends of the pulley shaft to apply an upwardly directed spring force against the pulley shaft to move the shaft in the holes; and a pulley supported by the pulley shaft.

10. The assembly of claim 9 further comprising a switch plate carried by the pulley shaft and which moves vertically with the pulley shaft.

11. The assembly of claim 9 further comprising a mounting mounted to one of the support blocks below the switch plate and a switch mounted to the mounting.

12. The assembly of claim 11 wherein the switch is a normally open switch, which is closed by contact with the switch plate as the switch plate moves vertically in a first direction with the pulley shaft.

* * * * *